United States Patent [19]

Miranda

[11] Patent Number: 5,003,320

[45] Date of Patent: Mar. 26, 1991

[54] MANUALLY ROTATABLE ANTENNA

[76] Inventor: Rafael Miranda, Box-HC 02-46127, Vega Baja, P.R. 00763

[21] Appl. No.: 470,305

[22] Filed: Jan. 25, 1990

[51] Int. Cl.[5] ..... H01Q 1/12

[52] U.S. Cl. ..... 343/763; 343/882; 74/501.6; 74/511 A

[58] Field of Search ..... 74/501.6, 505, 506, 74/511 A; 343/878, 765, 882, 763; 248/183, 178, 521, 522

[56] References Cited

U.S. PATENT DOCUMENTS

| | | | |
|---|---|---|---|
| 2,642,754 | 6/1953 | De Conti | 343/882 |
| 2,787,169 | 4/1957 | Farr et al. | 343/882 |
| 3,008,140 | 11/1961 | Rose | 343/882 |
| 3,665,477 | 5/1972 | Budrow et al. | 343/882 |
| 3,739,387 | 6/1973 | Budrow et al. | 343/882 |
| 4,204,214 | 5/1980 | Fassnacht | 343/765 |

OTHER PUBLICATIONS

Uphill, *Radio Communication*, Feb. 1976, pp. 118, 119.

*Primary Examiner*—Michael C. Wimer
*Attorney, Agent, or Firm*—Leon Gilden

[57] ABSTRACT

A manually rotatable antenna is set forth including an antenna with a bearing sleeve rotatably mounted with upper and lower spaced bearing plates securable to a dwelling. First and second cables are directed through a guide plate and through associated and respective guide bushings and rollers to a position interiorly of the control housing, including a chain member operative through a control gear manually manipulatable by an associated handle to rotate an antenna gear coaxially mounted about the bearing sleeve of the antenna mast.

5 Claims, 4 Drawing Sheets

11
12
12a
13a
13
13a
14
14a
15
18
16
17

MANUALLY ROTATABLE ANTENNA

BACKGROUND OF THE INVENTION

1. Field of the Invention

The field of invention relates to rotatable antennas, and more particularly pertains to a new and improved manually rotatable antenna wherein the same utilizes gear-driven cable links to manually rotate an associated antenna for positioning of the antenna in response to signal direction.

2. Description of the Prior Art

The prior art has utilized rotatable antennas of various types for positioning of the antenna in response to signal direction. Antennas of the prior art, however, have failed to utilize the precise gear-driven arrangement as set forth by the instant invention to more correctly orient an associated antenna in response to a control mechanism. For example the prior art includes U.S. Pat. No. 2,787,169 to Farr, et al., wherein a spaced cable is wound about a first pulley secured to an antenna mast directly downwardly to a lower pulley positioned about a shaft to reposition the antenna by repositioning of the cable. The Farr patent is typical of the prior art wherein the single cable and its associated positioning is utilized instead of the use of chain-link portions, as provided by the instant invention to provide a more accurate positioning of the antenna mast in response to a rotation of the chain portions.

U.S. Pat. No. 3,665,477 to Budrow, et al., sets forth an elevatable antenna wherein a cable is positioned to associate an extensible and retractable antenna portion in response to repositioning of the cable.

U.S. Pat. No. 2,642,754 to Conti sets forth the use of an antenna mast directed to an underlying handle portion wherein the coaxially aligned handle portion is rotated to rotate the associated antenna.

U.S. Pat. No. 3,008,140 to Rose sets forth a handle crank that is insertable into a gear drive to operatively reorient an antenna, wherein the Rose patent, as in other prior art, fails to set forth the convenience and precise positioning of the instant invention.

U.S. Pat. No. 3,739,387 to Budrow, et al., sets forth a modification of the previous Budrow, et al., utilizing a rotatable gear cooperating with a worm gear formed about a lower portion of the shaft of the mast for reorienting of the mast organization.

As such, it may be appreciated that there is a continuing need for a new and improved manually rotatable antenna as set forth by the instant invention which addresses both the needs of precise positioning of an associated antenna as well as ease of use of such an organization, and in this respect, the present invention substantially fulfills this need.

SUMMARY OF THE INVENTION

In view of the foregoing disadvantages inherent in the known types of rotatable antennas now present in the prior art, the present invention provides a manually rotatable antenna wherein the same utilizes a plurality of spaced cables utilizing chain link segments to reorient the antenna in response to rotation to the chain link segments. As such, the general purpose of the present invention, which will be described subsequently in greater detail, is to provide a new and improved manually rotatable antenna which has all the advantages of the prior art rotatable antennas and none of the disadvantages.

To attain this, the present invention includes an antenna with an elongate mast formed with a bearing shaft coupled to the mast at one end with the bearing shaft mounted into a bearing cup at its other end. An upper gear is mounted about the bearing shaft with the bearing shaft rotatably mounted within upper and lower plates that are in turn orthogonally secured to a guide plate mounted to a dwelling structure. Spaced cables are directed through the guide plate with upper ends of each cable secured to opposed terminal ends of a first chain segment with lower ends of the cable secured to opposed terminal ends of a lower chain segment. The lower chain segment is mounted about a lower gear, whereupon rotation of the lower gear rotates the upper gear and in response, rotates the antenna mast and antenna portion of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved manually rotatable antenna which has all the advantages of the prior art rotatable antennas and none of the disadvantages.

It is another object of the present invention to provide a new and improved manually rotatable antenna which may be easily and efficiently manufactured and marketed.

It is a further object of the present invention to provide a new and improved manually rotatable antenna which is of a durable and reliable construction.

An even further object of the present invention is to provide a new and improved manually rotatable antenna which is susceptible of a low cost of manufacture with regard to both materials and labor, and which accordingly is then susceptible of low prices of sale to the consuming public, thereby making such manually rotatable antennas economically available to the buying public.

Still yet another object of the present invention is to provide a new and improved manually rotatable antenna which provides in the apparatuses and methods of the prior art some of the advantages thereof, while simultaneously overcoming some of the disadvantages normally associated therewith.

Still another object of the present invention is to provide a new and improved manually rotatable antenna wherein the same is provided with precise antenna rotation in response to a control unit mounted in remote position relative to the antenna.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
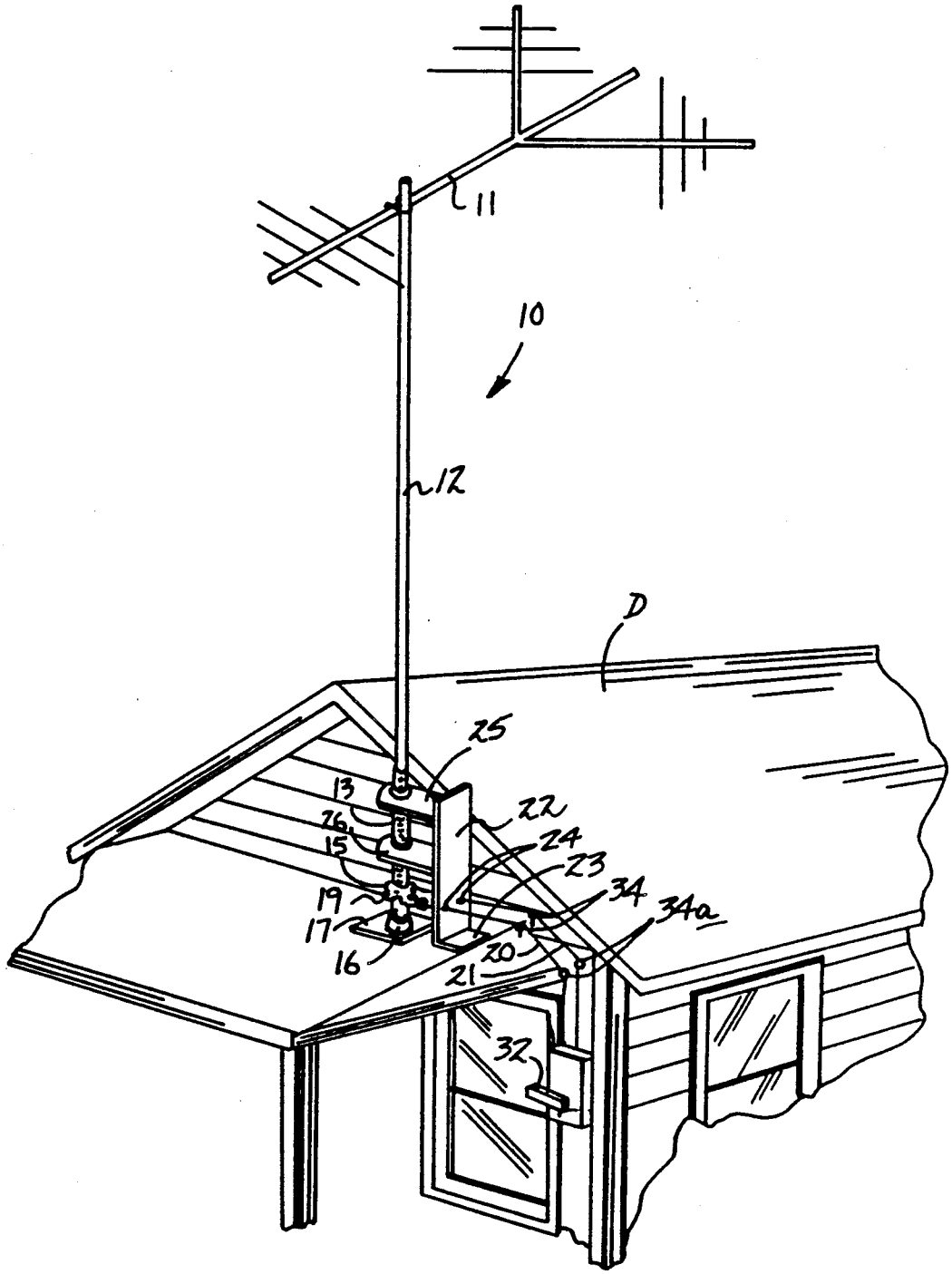
FIG. 1 is an isometric illustration of the instant invention secured to a dwelling structure.
Figure 2:
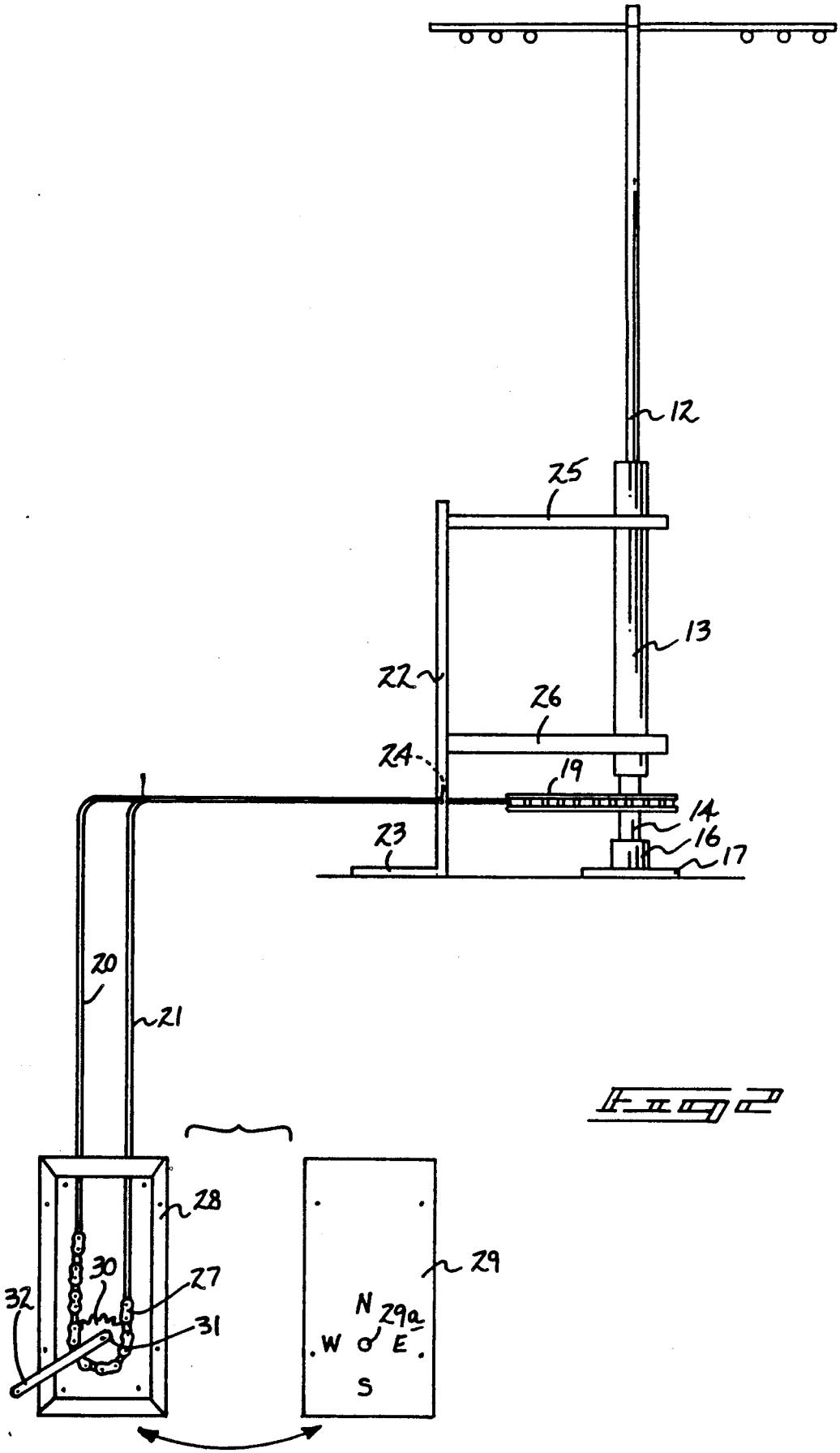
FIG. 2 is an orthographic illustration of the manually rotatable antenna organization of the instant invention.
Figure 3:
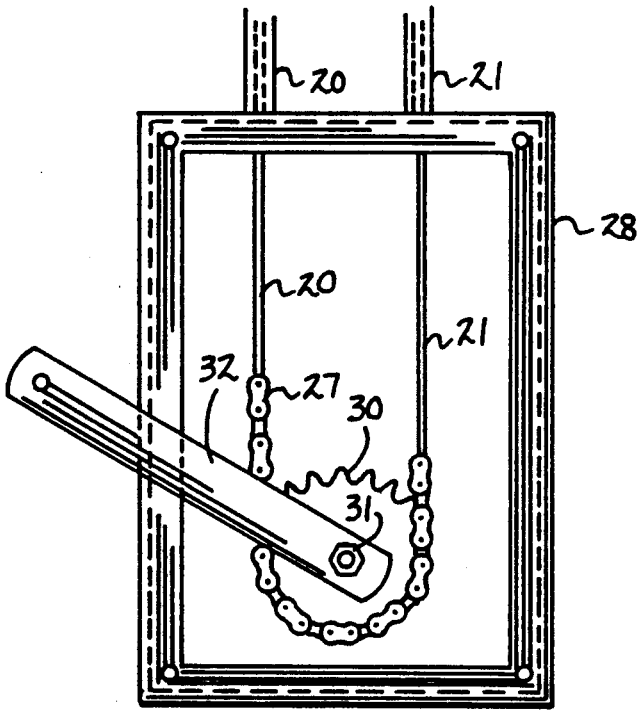
FIG. 3 is an orthographic illustration, somewhat enlarged, of the control housing and its organization.
Figure 4:
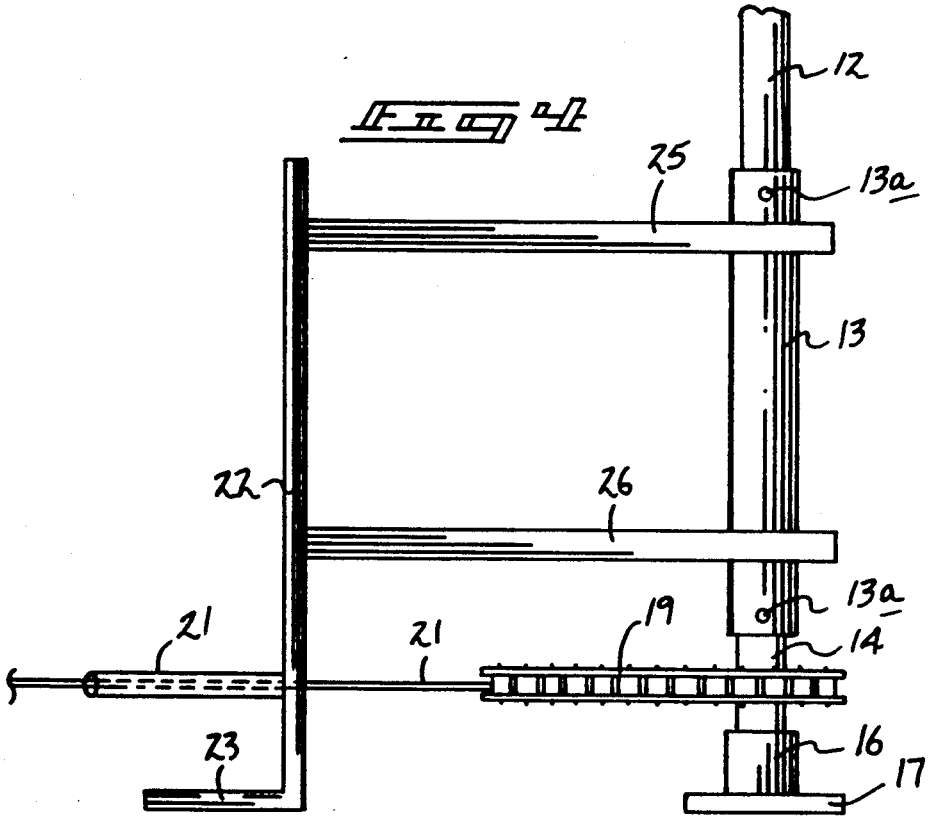
FIG. 4 is an orthographic view taken in elevation of the antenna drive mechanism.
Figure 5:
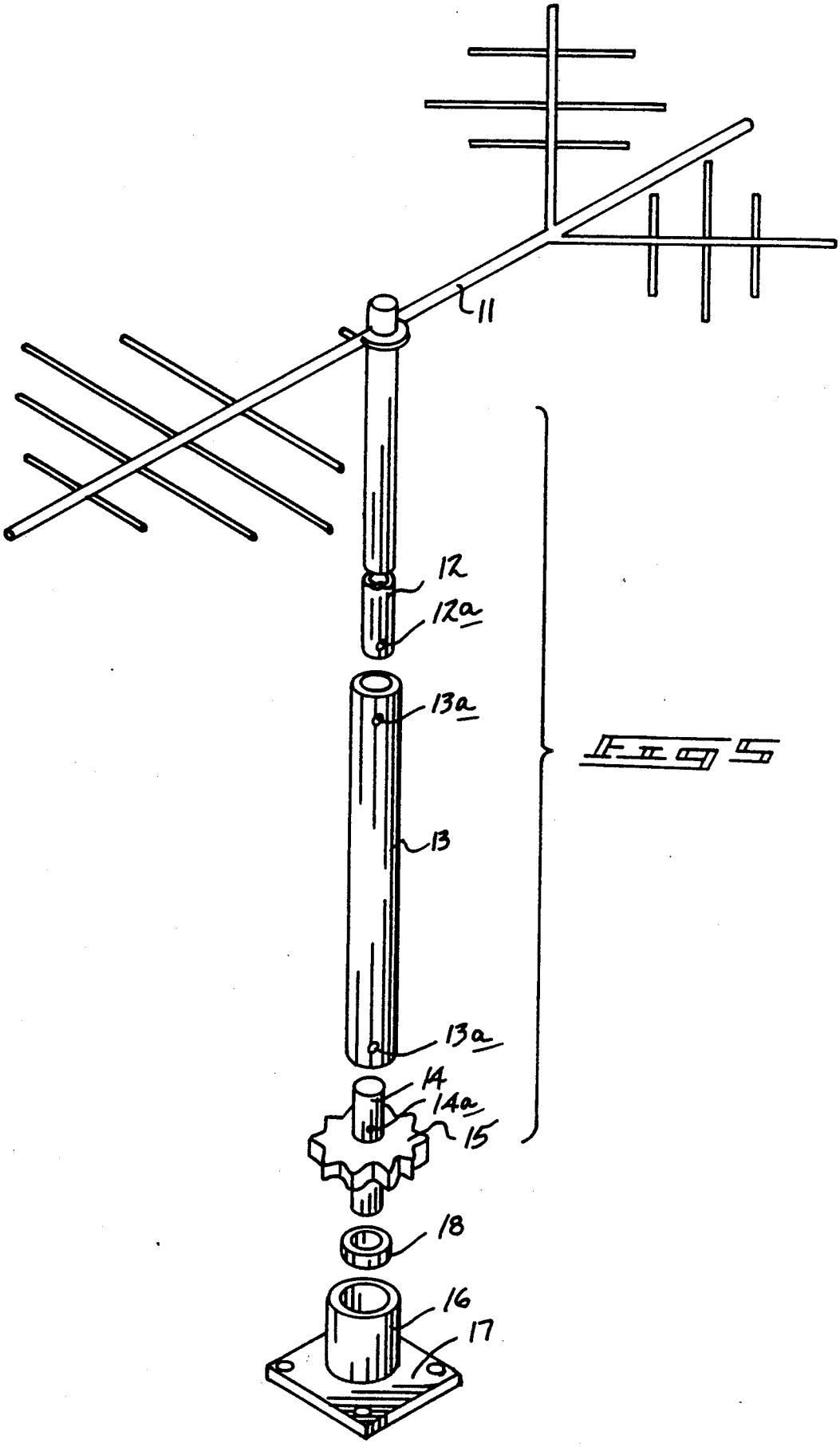
FIG. 5 is an isometric illustration of the antenna and mast organization, somewhat exploded for purposes of clarity.

With reference now to the drawings, and in particular to FIGS. 1 to 5 thereof, a new and improved manually rotatable antenna embodying the principles and concepts of the present invention and generally designated by the reference numeral 10 will be described.

More specifically, the manually rotatable antenna apparatus 10 essentially comprises an antenna head utilizing a support skeleton antenna head 11 fixedly secured to a vertical mast 12. The vertical elongate cylindrical mast is formed with a lower set of diametrically aligned apertures 12*a*. The apertures 12*a* and the lower end of the mast 12 is received within an upper portion of a cylindrical hollow bearing sleeve 13, wherein the bearing sleeve is provided with diametrically aligned apertures and lock pins 13*a* directed through the apertures within the bearing sleeve and within the apertures 12*a* of the mast to secure the mast to an upper end of the bearing sleeve. The lower end of the bearing sleeve is also formed with diametrically aligned apertures and lock pins 13*a* to receive a control shaft 14 and fixedly secure the control shaft interiorly of the bearing sleeve in a similar manner as the mast 12 is secured to the bearing sleeve. The control shaft is formed with diametrically aligned apertures 14*a*, as discussed above, to receive the lock pins 13*a* therethrough. An antenna gear 15 is coaxially mounted about the control shaft 14, wherein a lower end of the control shaft 14 is rotatably mounted within a support 16. The support cup 16 is of a cylindrical configuration receiving a bearing 18 therewithin, wherein the bearing 18 is provided with a central bore receiving in a fixedly secured manner the lower end of the control shaft. The support cup 16 is orthogonally mounted to a support plate 17 that in turn is mounted to an upper surface of a dwelling "D". A first chain segment 19 is operably mounted about the antenna gear 15 and is of a length equal to or greater than half the circumference of the antenna gear 15 to ensure adequate contact of the first chain segment 19 with the antenna gear 15. A plurality of coaxial cables comprising a first coaxial cable 20 and a second coaxial cable 21 are fixedly secured at their upper ends to opposed terminal ends of the first chain segment 19 and are slidingly mounted through guide plate apertures 24 formed within guide plate 22. The coaxial cables 21 and 22 are of conventional construction utilizing a fixed outer flexible sheath and a relatively movable inner cable. The guide plate 22 is formed with a lower guide plate leg 23 oriented generally orthogonally relative to the guide plate 22, wherein the guide plate leg 23 is mounted in a spaced relationship to the support plate 17. The guide plate 22 further has orthogonally and spatially mounted extending outwardly from an interior surface thereof, an upper and lower bearing plate 25 and 26 respectively. The upper and lower bearing plates 25 and 26 rotatably mount the bearing sleeve 13 and thereby órient and maintain the antenna organization in a predetermined vertical orientation as desired. The first and second coaxial cables 20 and 21 are directed at their lower ends and received within a control housing 28 and fixedly have secured at their lower ends a second chain segment 27 secured thereto with a second chain segment 27 operably mounted to a control gear 30. While housing 28 is illustrated as mounted to an exterior surface of a wall of the dwelling "D", it is understood the housing 28 is readily positionable interiorly of the dwelling "D" with the coaxial cables directed through an associated wall in operative communication between the housing 28 and the antenna organization. The second chain segment 27 is of a length substantially equal to or greater than half the circumference of the control gear 30 to secure adequate contact of the second chain segment 27 with the control gear with the control gear 30 rotatably mounted about a control gear axis 31. The control housing 28 includes a cover plate 29 with a gear axis aperture 29*a* formed therethrough to receive the control axis 31 and enable a control handle 32 mounted at an outer terminal end of the control 30, as illustrated in FIG. 1 for example. The first and second cables 20 and 21 are slidably guided by the guide bushings 34 mounted adjacent and in a spatial relationship relative to the guide plate 22 with an additional pair of guide bushings 34*a* (as illustrated in FIG. 1) positioned in a spatial relationship relative to the guide bushings 34 to enable directing of the control cables 20 and 21 interiorly of the control housing 28.

It is understood that the chain segment relationship with the associated gears enables a precise rotation of the antenna in response to rotation of the handle 32, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A manually rotatable antenna apparatus comprising, in combination, an antenna fixedly mounted to a vertical elongate mast, the mast fixedly mounted to a bearing sleeve, and the bearing sleeve including a driven gear, and a drive gear rotatably mounted remotely from the driven gear within a control housing, and a flexible drive line operably associating the drive gear to the driven gear, and lever means secured to the drive gear to permit selective rotation of the drive gear, and the driven gear is coaxially mounted about the bearing sleeve, and the bearing sleeve is fixedly mounted to the mast, and the bearing sleeve further including a bearing mounted at a lowermost end thereof and the bearing mounted within a bearing cup, the bearing cup including a support plate orthogonally secured to the bearing cup to enable mounting of the support plate to a support structure, and the flexible drive line includes an upper chain segment in engagement with the driven gear, wherein the upper chain segment is of a length substantially equal to or greater than that defined by half the circumference of the driven gear, and the flexible drive line further including a lower chain segment in operative engagement with the drive gear, and the lower chain segment of a length substantially equal to or greater than that defined by half the circumference of the drive gear, and a first flexible cable and a second cable wherein the upper end of the first and second flexible cables are secured to terminal ends of the upper chain segment, and lower ends of the first and second cable are secured to terminal ends of the lower chain segment.

2. A manually rotatable antenna apparatus as set forth in claim 1 including a guide plate, the guide plate including an orthogonally secured leg integrally secured to a lower end of the guide plate, and the guide plate further including spaced through-extending apertures, the spaced through-extending apertures receiving the respective first and second cables therethrough, and the guide plate further including upper and lower bearing plates orthogonally and integrally secured to a forward face of the guide plate, and the upper and lower bearing plates rotatably mounting the bearing sleeve orthogonally through the upper and lower bearing plates.

3. A manually rotatable antenna apparatus as set forth in claim 5 wherein the control housing includes a control axle axially aligned and integrally secured orthogonally relative to the drive gear, and forward terminal end of the axle integrally mounted to a handle, the handle orthogonally secured relative to the axle.

4. A manually rotatable antenna apparatus as set forth in claim 3 including a cover plate overlying the control housing between the handle at an upper peripheral edge of the control housing, the control housing including a through-extending aperture accommodating the axle therethrough.

5. A manually rotatable antenna apparatus as set forth in claim 4 further including a plurality of first and second guide bushings to slidingly receive the first and second cables therethrough remote from the guide plate, and further including first and second further guide bushings spaced from the first and second guide bushings permitting angular directing of the first and second cables therethrough.

* * * * *